US005638838A

United States Patent [19]

Lombardi

[11] Patent Number: 5,638,838

[45] Date of Patent: Jun. 17, 1997

[54] COSMETIC COMPACT HAVING SNAP-ON HINGE

[76] Inventor: Carl M. Lombardi, 424 W. Neck Rd., Lloyd Harbor, N.Y. 11743

[21] Appl. No.: 603,235

[22] Filed: Feb. 20, 1996

[51] Int. Cl.[6] ..... A45D 33/24; A45D 33/26

[52] U.S. Cl. ..... 132/294; 132/301; 132/314; 132/315; 132/295; 220/338; 220/341; 206/581

[58] Field of Search ..... 132/293, 294, 132/295, 301, 304, 314, 315, 316, 317, 318; 220/337, 338, 341, 343; 206/581, 823, 235

[56] References Cited

U.S. PATENT DOCUMENTS

| | | | |
|---|---|---|---|
| 4,235,345 | 11/1980 | VandeDrink et al. | 220/338 |
| 5,092,354 | 3/1992 | Pacelli et al. | 132/294 |
| 5,107,871 | 4/1992 | Butcher et al. | 132/293 |
| 5,167,351 | 12/1992 | Prout et al. | 220/338 |
| 5,375,734 | 12/1994 | Tiramani | 206/581 |
| 5,564,592 | 10/1996 | Martin et al. | 220/338 |

*Primary Examiner*—Gene Mancene
*Assistant Examiner*—Pedro Philogene
*Attorney, Agent, or Firm*—Michael Ebert

[57] ABSTRACT

A cosmetic compact formed by an open container having stored therein a facial powder, and a hinged cover to close the container, the cover having a mirror mounted on its inner wall which when the cover is swung open to assume a predetermined obtuse viewing angle, the user holding the compact can then observe her face while applying powder thereto. The hinge includes a pair of spaced gudgeons projecting from the rear wall of the container and bridged by a pivot pin, each gudgeon having formed on one side a stop positioned between the corresponding end of the pivot pin where it joins the gudgeon and the rear wall. At the rear of the cover at a right angle thereto is a pair of resilient jaws formed by parallel front and back plates which snap-fit into the space between the gudgeons to clamp onto the pin. When the cover is swung open to assume the predetermined obtuse angle with respect to the container, the leading edge of the front plate then abuts the stops and the cover is thereby maintained at this angle. But if the cover is forced beyond this angle, the hinge will not break, but the cover will snap off the pin and can thereafter be snapped back to restore the hinge.

7 Claims, 2 Drawing Sheets

FIG. 1
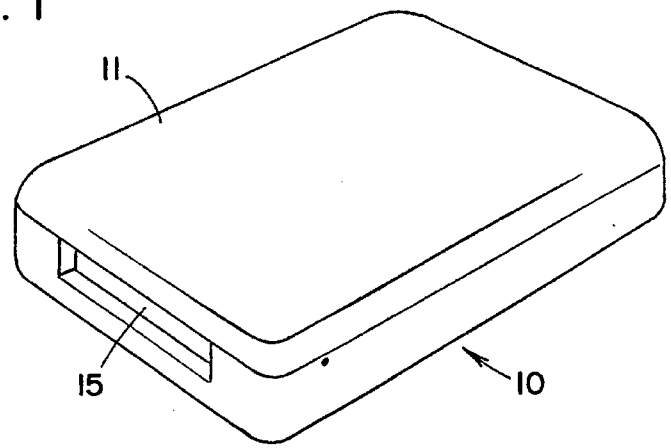
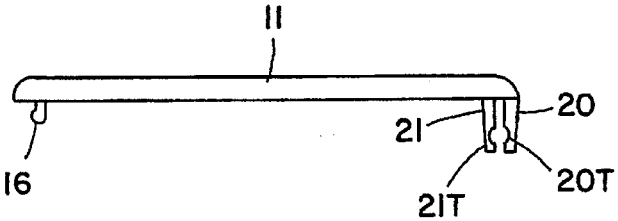
FIG. 5
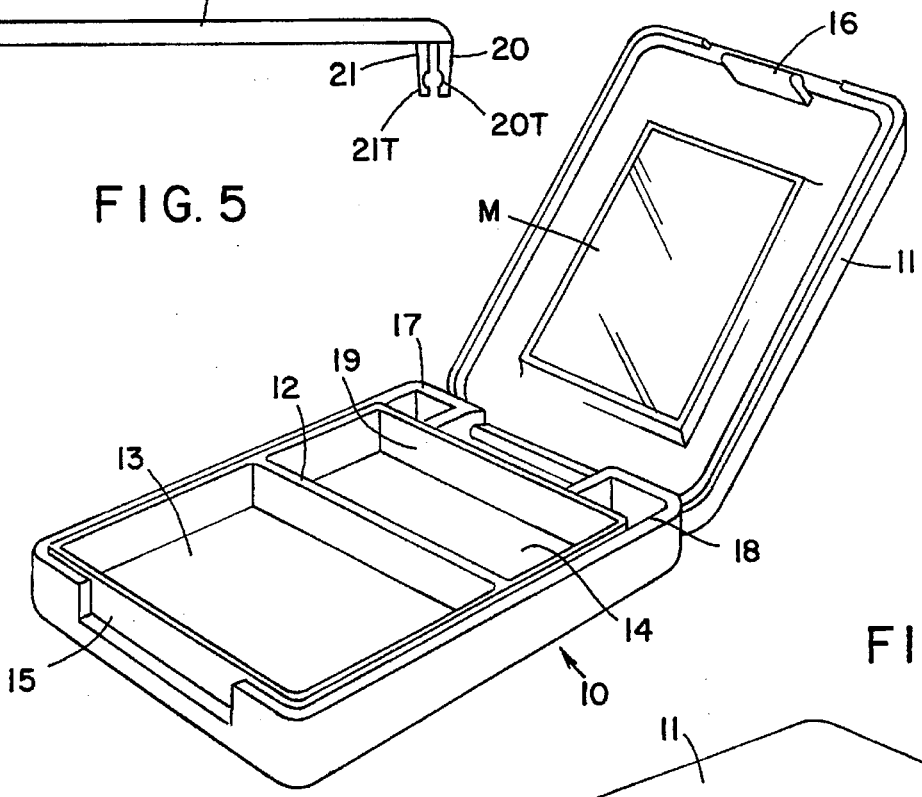
FIG. 3
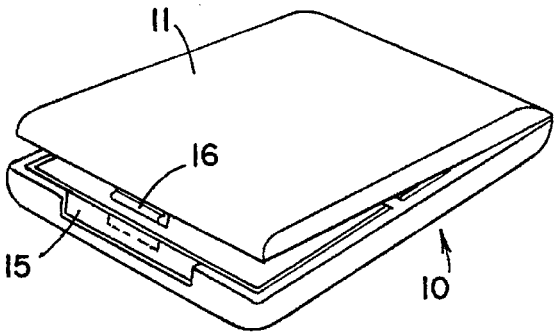
FIG. 2

COSMETIC COMPACT HAVING SNAP-ON HINGE

BACKGROUND OF INVENTION

1. Field of Invention

This invention relates generally to cosmetic compacts in which facial powders or other cosmetics to be applied to the face of a user are stored, and more particularly to a compact whose container has a cover hinged thereto by a snap-on hinge which when the cover is swung open to assume a predetermined mirror viewing angle with respect to the container, the hinge maintains the cover at this angle, and should the cover be forced to a greater angle, it will then snap off the container without breaking the hinge.

2. Status of Prior Art

The term makeup, in the sense this term is used in cosmetics, encompasses the full range of cosmetics employed by women to beautify and color their face. Included in this term are pressed facial powders, blushes, mascara and eye shadow. These cosmetics, when stored in a compact, may be applied by a finger to a user's face, or by brushes or other applicators.

The typical facial powder compact in current use takes the form of a container having an oyster or other shape having stored therein a supply of pressed facial powder, and a cover having a small mirror mounted on its inner wall hinged to the rear of the container so that when the cover is swung open, the user holding the compact can observe her face while applying powder thereto.

The rear hinge in many compacts, especially most upscale compacts, includes a brass hinge pin on which the cover swings. When the cover is swung up, it should be held open at all angular positions without falling back onto the container. And it should, when fully opened, be maintained at an optimum obtuse angle of 110 degrees, for this is the best angle to view the face in the mirror.

The ability of a compact to stay open at an angle of 110 degree is important because the user will typically hold the compact in the palm of her hand while viewing the mirror as she applies the cosmetic to her face; hence it is best that the mirror be tilted away from the face.

In many commercially available compacts which make use of a pin-type hinge, the nature of the hinge is such that when the cover is swung open, it is not then maintained at an adjusted angle, but is free to fall back on the container. Compacts of the type leave much to be desired, for the user holding the compact in the palm of her hand must at the same time with her fingers try to hold the cover at a proper viewing angle.

Also known are compacts which exclude the use of a hinge pin and instead provide a ball and socket arrangement in which ball-shaped molded protrusions on the hinge side of the cover snap into corresponding molded U-shaped protrusions on the hinge side of the container. But a ball and socket hinge of this type does not impose a limit on the angle at which the cover can be swung open, making it necessary for the user to adjust the angle of the swung-open cover so as best to see the mirror.

SUMMARY OF INVENTION

In view of the foregoing, the main object of the invention is to provide a cosmetic compact with a pin type snap-on hinge making it possible to snap the cover onto the container, the cover snapping off without breaking the hinge when the cover is swung open beyond a predetermined obtuse viewing angle with respect to the container.

A significant advantage of this invention is that when the cover is snapped off the container, it may readily be snapped back to restore the hinge.

More particularly, an object of the invention is to provide a compact of the above type having stops incorporated in the snap-on hinge which act to maintain the cover at a predetermined obtuse angle so that the user has no need to adjust the viewing angle of the cover, but merely to swing it open.

Also an object of the invention is to provide a compact of the above type having a snap-on hinge which resists the swing of the cover and thereby prevents it from falling back on the container when the cover is released by the user.

Yet another object of the invention is to provide a cover of the above type which is of high quality, yet may be mass-produced at relatively low cost.

Briefly stated, these objects are attained by a cosmetic compact formed by an open container having stored therein a facial powder, and a hinged cover to close the container, the cover having a mirror mounted on its inner wall which when the cover is swung open to assume a predetermined obtuse viewing angle, the user can then observe her face while applying powder thereto.

The hinge includes a pair of spaced gudgeons projecting from the rear of the container and bridged by a pivot pin, each gudgeon having formed on one side a stop positioned between below the corresponding end of the pivot pin where it joins the gudgeon and the rear wall. At the rear of the cover at a right angle thereto is a pair of resilient jaws formed by parallel front and back plates which snap-fit into the space between the gudgeons to clamp onto the pin. When the cover is swung open to assume the predetermined obtuse angle with respect to the container, the leading edge of the plate then obtuse the stops and the cover is thereby maintained at this angle. But if the cover is forced beyond this angle, the hinge will not break, but the cover will snap off the pin and can thereafter be snapped back to restore the hinge.

BRIEF DESCRIPTION OF DRAWING

For a better understanding of the invention as well as other objects and further features thereof, reference is made to the following detailed description to be read in conjunction with the accompanying drawings, wherein:

FIG. 1 shows, in perspective, a compact in accordance with the invention in its closed state;

FIG. 2 shows the compact in its fully opened state to expose the open container and the cover hinged thereto;

FIG. 3 is a front view of the compact when partially opened;

FIG. 5 is a side view of the cover;

DESCRIPTION OF INVENTION

Figure 4:
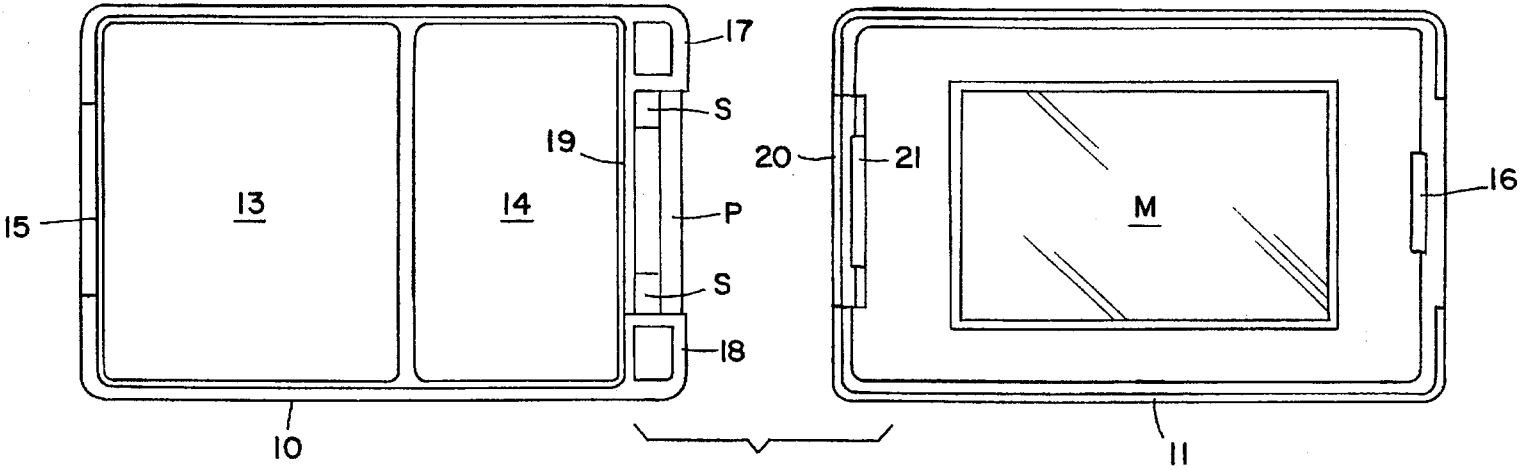
FIG. 4 shows the open top container of the compact separated from its cover whose inside mirror is seen.

Referring now to FIGS. 1 and 2 showing a cosmetic compact in accordance with the invention, the main components of the compact are a shallow, rectangular open-top container 10 on which is hinged a matching lid or cover 11. Mounted on the inner wall of cover 11 is a small mirror M.

Container 10 is divided by a transverse partition wall 12 into a front compartment 13 adapted to receive a pad of pressed facial powder or an other cosmetic, such as mascara, to be applied to the face of a user, and a rear compartment 14 to accommodate a brush or other cosmetic applicator. The front wall of the container is provided with a detent wall 15 which is engaged by a latch piece 16 projecting from the front end of cover 11 when the cover is closed.

Figure 6:
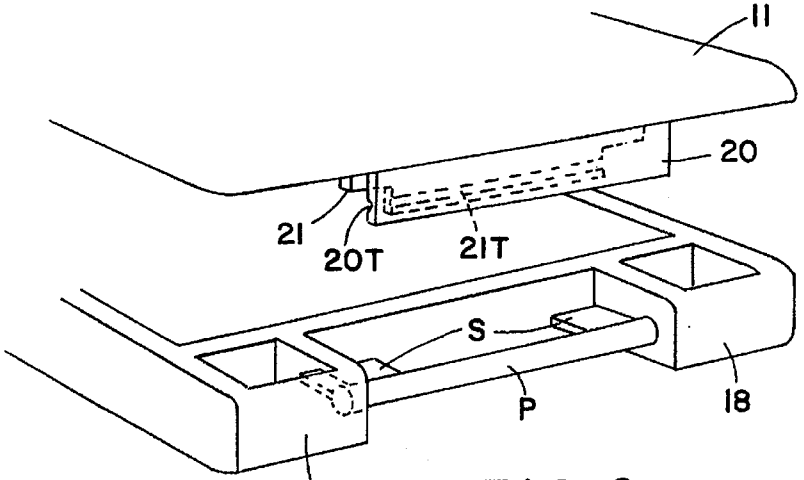
FIG. 6 separately illustrates the two elements which make up the snap-on hinge, one including a hinge pin supported at the rear of the container, the other resilient jaws to clamp onto the pin supported at the rear of the cover.

The cover is hinged to the container by a snap-on hinge one element of which, as best seen in FIGS. 4 and 6 is formed by a pair of spaced gudgeons 17 and 18 projecting from the rear wall 19 of container 11. The spaced gudgeons 17 and 18 are bridged by a pivot pin P which is parallel to the rear wall 19 of the container.

Molded on the inner side of each gudgeon at a position between rear wall and pivot pin P at the point where the end of the pin joins the gudgeon is a small stop S. The entire compact, except for mirror M, is molded of synthetic plastic material such as polyethylene or polypropylene, so that all elements of the compact including the snap-on-hinge are integrated.

Cover 11 whose front end is provided with latch 16 is provided at its rear end with a pair of resilient jaws which are adapted to engage the pivot pin P at the rear of the container. The resilient jaws which are adapted to fit into the space between trunions 17 and 18 projecting from the rear of the container are formed by a parallel front and rear plates 20 and 21 at right angles to the plane of the cover.

As best seen in FIG. 6, the resilient jaw plates 20 and 21 are provided with complementary troughs 20T and 21T running their full length of the plates adjacent their leading edges. When the jaws are snapped onto pivot pin P at the rear end of the container, the pin which has a circular cross section falls into the troughs and is clamped between the plates. While the cover is pivoted on pin P and can be swung to any desired angle, with respect to the container, the swing is resisted by the resilient jaws clamping the pin; hence when the cover is angled, as shown in FIG. 3, it will not fall back on the container.

Figure 7:
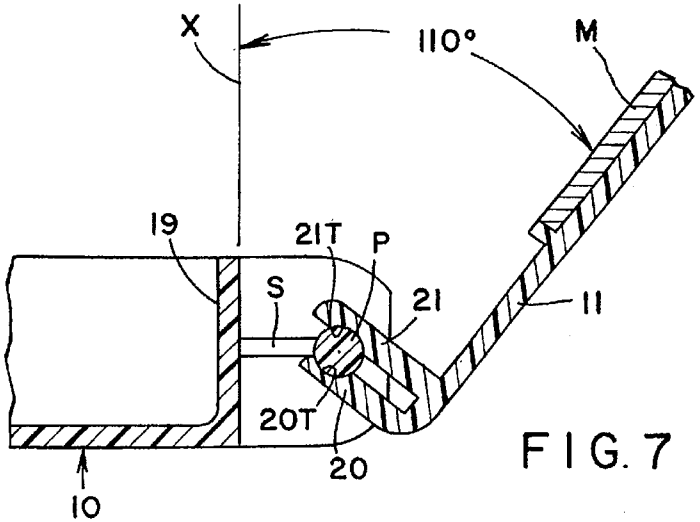
FIG. 7 illustrates schematically the swung-open cover and how it is maintained at a desired obtuse angle relative to the container by stops.

As best seen in FIG. 7, the degree to which the cover may be opened is limited by stops S on the gudgeons supporting pin P, the stops being between the ends the pin where they join the gudgeons and rear wall 19 of the container.

Hence when the cover assumes the optimal mirror viewing angle of 110 degrees with respect to axis X which is at right angles to container 10, the leading edge of the front plate 20 then abuts the stops S, thereby preventing angling of the cover beyond the 110 degree viewing angle.

But if the user forces the cover beyond the obtuse viewing angle, the resilient jaws will become disengaged from pivot P and snap off without however breaking the hinge. It is a simple matter to thereafter restore the hinge, for one has only to snap the jaws back onto the pin.

Hence in a compact in accordance with the invention, the nature of the snap-on hinge is such as to prevent the cover, when the compact is opened, from falling back onto the container, the hinge maintaining the cover at the desired obtuse viewing angle. And the hinge will not break if the cover is forced beyond this viewing angle, for this cover will then simply snap off the container.

While there has been disclosed a preferred embodiment of a cosmetic compact having snap-on hinge in accordance with the invention, it will be appreciated that many changes may be made thereon without departing from the spirit of the invention. Thus while the compact is shown having a rectangular shape, in practice it may have any other shape suitable for a compact, such as an oval or oyster shape.

I claim:

1. A cosmetic compact comprising:

A. container having an open top adapted to store a cosmetic to be applied to the face of a user;

B. a cover for the container having a mirror mounted on its inner surface so that when the cover is opened, the user holding the compact can view her face while applying the cosmetic thereto; and C. a snap-on hinge hinging a rear side of the cover to a corresponding side of the container, said hinge including:

($C_1$) a pair of spaced gudgeons projecting from the side of the container and bridged by a pivot pin spaced from this side, and a stop on each gudgeon placed between the end of the pin where the pin joins the gudgeon and the side of the container; and ($C_2$) a pair of resilient jaws mounted on the rear side of the cover at right angles thereto formed by parallel front and rear plates which fit to the space between the gudgeons and clamp onto the pin, said front plate having a leading edge which is adapted to engage the stop on each gudgeon when the hinged cover is swing open whereby when the cover is opened, it can be swung to assume a predetermined obtuse viewing angle with respect to the open container and is maintained at this angle by the stops on each gudgeon which at this angle is abutted by the leading edge of the front plate.

2. A compact as set forth in claim 1, which, with the exception of the mirror, is molded of synthetic plastic material.

3. A compact as set forth in claim 1, in which the compact has a rectangular shape.

4. A compact as set forth in claim 1, in which the container is divided into a compartment for accommodating a cosmetic and a compartment for accommodating an applicator therefor.

5. A compact as set forth in claim 1, in which a front wall of the container is provided with a detent and a front wall of the cover is provided with a projecting latch piece which engages the detent when the cover is closed.

6. A compact as set forth in claim 1, in which the obtuse viewing angle is about 110 degrees.

7. A compact as set forth in claim 1, in which the resilient jaws frictionally engage the pin to prevent the cover, when said cover is opened to any angle, from falling back on the container.

* * * * *